US012398949B2

(12) United States Patent
Ma et al.

(10) Patent No.: US 12,398,949 B2
(45) Date of Patent: Aug. 26, 2025

(54) AIR-COOLED REFRIGERATOR

(71) Applicants: QINGDAO HAIER REFRIGERATOR CO., LTD., Shandong (CN); HAIER SMART HOME CO., LTD., Shandong (CN)

(72) Inventors: Jian Ma, Shandong (CN); Changzhi Wang, Shandong (CN); Bin Fei, Shandong (CN); Noda Toshinori, Shandong (CN); Lingyun Dong, Shandong (CN); Jianquan Chen, Shandong (CN); Hui Liu, Shandong (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 173 days.

(21) Appl. No.: 18/019,861

(22) PCT Filed: Aug. 17, 2021

(86) PCT No.: PCT/CN2021/112992
§ 371 (c)(1),
(2) Date: Feb. 6, 2023

(87) PCT Pub. No.: WO2022/037574
PCT Pub. Date: Feb. 24, 2022

(65) Prior Publication Data

US 2023/0280088 A1 Sep. 7, 2023

(30) Foreign Application Priority Data

Aug. 18, 2020 (CN) ..... 202010833861.3

(51) Int. Cl.
*F25D 23/06* (2006.01)
*F25D 17/06* (2006.01)

(52) U.S. Cl.
CPC ..... *F25D 23/066* (2013.01); *F25D 17/062* (2013.01); *F25D 2317/068* (2013.01)

(58) Field of Classification Search
CPC ..... F25D 2317/068; F25D 23/066; F25D 17/062; F25D 17/08; F25D 17/067; F25D 2317/0661; F25D 23/068; F25D 23/067
See application file for complete search history.

(56) References Cited

U.S. PATENT DOCUMENTS 3,670,521 A * 6/1972 Dodge, III ..... F25D 23/069 62/298
5,662,394 A * 9/1997 Choi ..... A47F 3/0408 312/116

(Continued)

FOREIGN PATENT DOCUMENTS

CN 1611876 A 5/2005
CN 204043273 U 12/2014

(Continued)

OTHER PUBLICATIONS

Chinese Intellectual Property Office (ISR/CN), "International Search Report for PCT/CN2021/112992", China, Nov. 17, 2021.

(Continued)

*Primary Examiner* — David J Teitelbaum
(74) *Attorney, Agent, or Firm* — troutman pepper locke; Tim Tingkang Xia, Esq.

(57) ABSTRACT

An air-cooled refrigerator comprises a bottom liner, a fan bottom shell, an air duct cover plate, and fan blades. A cooling chamber and a storage space are defined in the bottom liner. The fan bottom shell is arranged at a rear portion of the cooling chamber. The air duct cover plate comprises a back plate portion and a fan upper cover. The (Continued)

back plate portion is disposed in front of a rear wall of the bottom liner. The fan upper cover obliquely extends downward from a lower end of the back plate portion into the cooling chamber, covers the fan bottom shell and is fastened thereto. The back plate portion and the fan upper cover are integrally formed. The fan blades are arranged in a fan cavity, and enable formation of a refrigeration airflow discharged from the cooling chamber to an air supply duct.

8 Claims, 8 Drawing Sheets

(56) References Cited

U.S. PATENT DOCUMENTS

| | | | | |
|---|---|---|---|---|
| 2017/0276421 | A1* | 9/2017 | Candeo | F04D 29/601 |
| 2018/0172336 | A1* | 6/2018 | Bae | F25D 17/062 |
| 2018/0259241 | A1* | 9/2018 | Han | F25D 17/067 |
| 2019/0249918 | A1* | 8/2019 | Marinello | F25D 23/02 |
| 2021/0038755 | A1* | 2/2021 | Eide | B01D 53/885 |
| 2022/0163250 | A1* | 5/2022 | Wang | F25D 17/067 |
| 2023/0098419 | A1* | 3/2023 | Ingargiola | F25D 17/045 62/407 |

FOREIGN PATENT DOCUMENTS

| | | | |
|---|---|---|---|
| CN | 109695996 | A | 4/2019 |
| CN | 110285629 | A | 9/2019 |
| CN | 110375477 | A | 10/2019 |
| CN | 110375494 | A | 10/2019 |
| CN | 209893729 | U | 1/2020 |
| IN | 210832696 | U | 6/2020 |

OTHER PUBLICATIONS

SIPO, "1st CN Office Action and Search Report for CN Application No. 202010833861.3", China.
SIPO, "2nd CN Office Action and Search Report for CN Application No. 202010833861.3", China.
EPO, "Supplementary European Search Report for EP Application No. 21857666.8", Hague, Germany, Oct. 26, 2023.

* cited by examiner

AIR-COOLED REFRIGERATOR

CROSS-REFERENCE TO RELATED PATENT APPLICATION

This application is a U.S. national stage application of PCT Patent Application No. PCT/CN2021/112992 filed Aug. 17, 2021, which claims priority to and the benefit of Chinese Application No. 202010833861.3 filed Aug. 18, 2020, which are incorporated herein in their entireties by reference.

FIELD OF THE INVENTION

The present invention relates to refrigerating and freezing technologies, and particularly relates to an air-cooled refrigerator.

BACKGROUND OF THE INVENTION

In an existing refrigerator, a duct plate and a fan volute provided in the duct plate are generally two devices independent of each other. During assembly, an installer generally needs to connect the duct plate with the fan volute by means of a large number of fasteners, which may lead to a complex installation process and increased cost, thus being not conducive to mass production.

BRIEF DESCRIPTION OF THE INVENTION

One objective of the present invention is to overcome at least one defect in the prior art and to provide an air-cooled refrigerator.

One further objective of the present invention is to simplify installation processes of the refrigerator.

Another further objective of the present invention is to fix a rear end of a longitudinal partition to a bottom liner, so as to reduce the weight borne by an evaporator upper cover and improve the stability of the refrigerator.

Particularly, the present invention provides an air-cooled refrigerator, including:

a bottom liner, defining a cooling chamber and a storage space, the cooling chamber being provided below the storage space;

a fan bottom shell, provided at a rear portion of the cooling chamber; and an air duct cover plate, including:

a back plate portion, provided in front of a rear wall of the bottom liner, and defining an air supply duct together with the rear wall of the bottom liner, at least one air supply outlet being formed in the back plate portion, and the air supply outlet being configured to make the air supply duct communicate with the storage space; and a fan upper cover, obliquely extending downwards from a lower end of the back plate portion into the cooling chamber, covering the fan bottom shell and being fastened thereto to form, together with the fan bottom shell, a fan cavity for accommodating fan blades, the back plate portion and the fan upper cover being integrally formed;

the air-cooled refrigerator also including:

the fan blades, provided inside the fan cavity, and enabling formation of a refrigeration air flow discharged from the cooling chamber to the air supply duct.

Further, the fan blades are centrifugal blades, and the fan cavity formed by the fan upper cover and the fan bottom shell has a volute shape, an air inlet being formed in the fan upper cover, and an exhaust outlet being formed at a position where the fan upper cover is connected with the back plate portion.

Further, the air-cooled refrigerator also includes:

an evaporator, having an overall flat cuboid shape and being arranged on a front portion of the cooling chamber;

a bottom wall of the bottom liner including:

an evaporator supporting part, configured to support the evaporator; and a fan supporting part, obliquely provided upwards from front to back from a rear end of the evaporator supporting part, the fan bottom shell being fixed to the fan supporting part, such that the fan cavity is overall obliquely provided behind the evaporator.

Further, a bottom of the fan bottom shell is provided with a plurality of damping adhesive pads, and bonded to the fan supporting part by using the plurality of damping adhesive pads.

Further, the air-cooled refrigerator also includes:

a longitudinal partition, vertically provided in a middle of the storage space to separate the storage space into two transversely-arranged storage cavities; and a back fixing assembly, provided on the rear wall of the bottom liner, and having a supporting block facing the storage space to support the longitudinal partition by using the supporting block.

Further, the back fixing assembly includes:

a supporting base, fixed to a rear side of a back portion of the bottom liner; and a bearing frame, provided on a front side of the back portion of the bottom liner, and connected with the supporting base by means of a fastener, the bearing frame protruding towards the storage space to form the supporting block, and the back plate portion forms a supporting jacket protruding towards the storage space at a position corresponding to the bearing frame, the supporting block is inserted into the supporting jacket, and the supporting jacket is matched with a fixing structure provided at a rear end of the longitudinal partition, such that the longitudinal partition is supported by matching the supporting jacket with the fixing structure of the longitudinal partition.

Further, one side of the back plate portion facing the air supply duct forms an air guiding jacket on a periphery of the bearing frame to avoid an air flow from forming a turbulent flow at the bearing frame.

Further, the air guiding jacket is provided extending along a height direction of the back plate portion, and forms a streamline tip at its bottom end to guide the air flow by using the tip.

Further, the air duct cover plate is an integrally injection-molded single-layer plate, and an upper portion of the back plate portion is provided with a crease groove to facilitate bending of the back plate portion by using the crease groove when installing the air duct cover plate.

Further, the back plate portion is also provided with at least one transversely extending water retaining rib below the air supply outlet to block condensate water at the air supply outlet from flowing downwards into the fan cavity.

In the air-cooled refrigerator of the present invention, the back plate portion and the fan upper cover are integrally formed to form modularization and facilitate batch production, and during assembly, the installer may install an integrally-formed piece first, and then may directly connect an evaporator upper cover with the integrally-formed piece, thereby simplifying installation processes and reducing costs, and ensuring the stability of a whole air duct structure.

In the air-cooled refrigerator of the present invention, the bottom liner is provided with the longitudinal partition, the rear end of the longitudinal partition abuts against the air duct cover plate, the back plate portion forms the supporting jacket protruding towards the storage space, the rear end of the longitudinal partition is provided with a sunken part matched with the supporting jacket of the back plate portion, the supporting block may extend into the supporting jacket, and then an assembly formed by the supporting block and the supporting jacket extends into the sunken part; in this way, the rear wall of the bottom liner, the back plate portion and the longitudinal partition are fixed together by means of the back fixing assembly, so as to transfer part of the weight of the longitudinal partition to the rear wall of the bottom liner, thereby sharing the pressure of the evaporator upper cover.

These and other objectives, advantages and features of the present invention will be better understood by those skilled in the art in the light of the detailed description of specific embodiments of the present invention in conjunction with the accompanying drawings below.

BRIEF DESCRIPTION OF THE DRAWINGS

Some specific embodiments of the present invention will be described below in detail in an exemplary and non-limiting manner with reference to the accompanying drawings. Identical reference numerals in the accompanying drawings indicate identical or similar components or parts. It should be understood by those skilled in the art that these accompanying drawings are not necessarily drawn to scale. In the drawings.

DETAILED DESCRIPTION

In the description of the embodiment, it should be understood that, orientation or position relationships indicated by terms "longitudinal," "transverse," "length," "width," "thickness," "upper," "lower," "front," "rear," "left," "right," "vertical," "horizontal," "top," "bottom," "depth," etc. are based on orientations of a refrigerator in normal use as a reference, and can be determined with reference to orientation or position relationships as shown in accompanying drawings. For example, "front" for indicating an orientation refers to a side of the refrigerator facing a user. It is merely for ease of describing the present invention and simplifying the description, and not for indicating or implying the device or component referred to should have a specific orientation and be constructed and operated in the specific orientation, and thus it cannot be interpreted as the limitation on the present invention.

Figure 1:
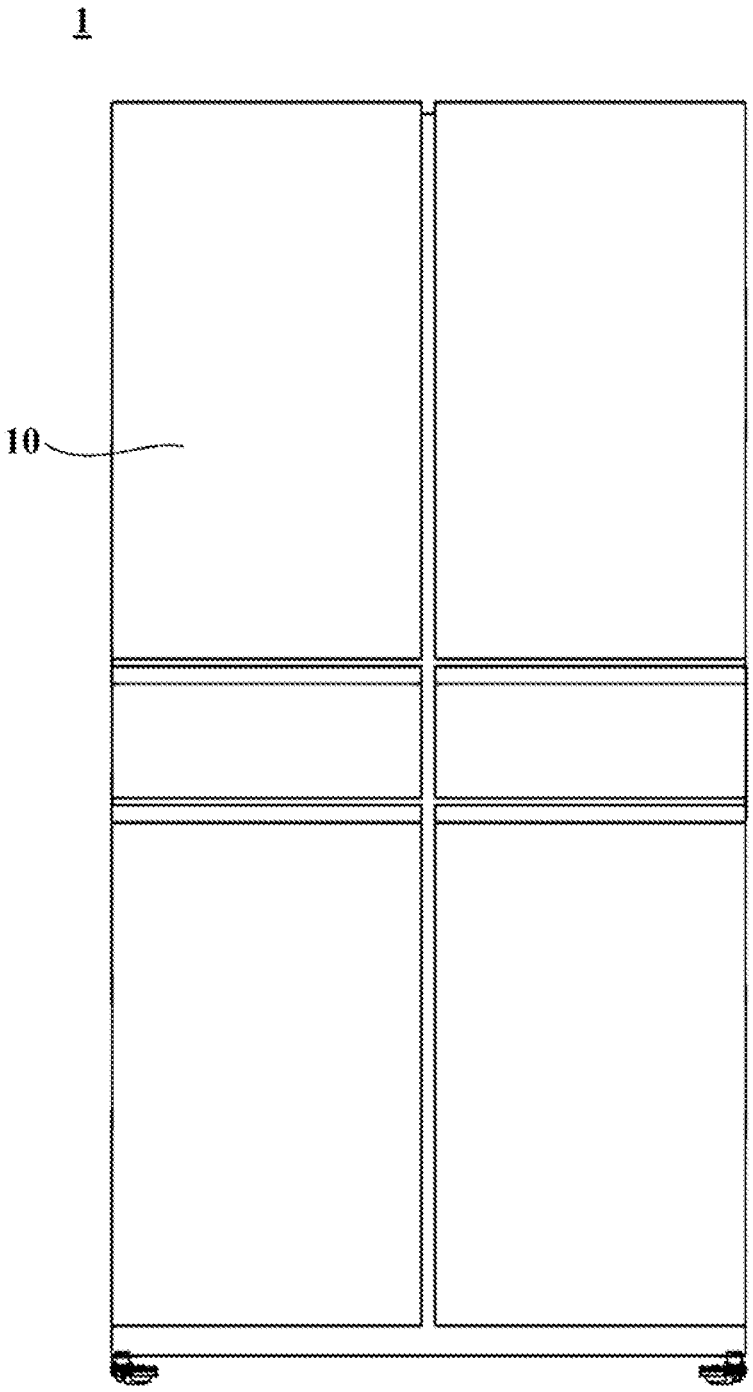
FIG. 1 is a schematic diagram of a refrigerator according to an embodiment of the present invention.

See FIG. 1, a refrigerator 1 of the embodiment may generally include a refrigerator body 10. The refrigerator body 10 may be composed of a housing, a liner, a heat insulation layer and other accessories. The housing is an outer layer structure of the refrigerator, and protects the whole refrigerator. In order to isolate heat conduction from the outside, the heat insulation layer is added between the housing and the liner of the refrigerator body 10, and the heat insulation layer is generally made by means of a foaming process. There may be one or more liners, which may be arbitrarily divided into a refrigerating liner, a variable temperature liner, a freezing liner and the like according to functions. The specific number and functions of the liners may be configured according to usage demands of the refrigerator. In the embodiment, the liner at least includes a bottom liner 100, which may generally be a freezing liner.

Figure 2:
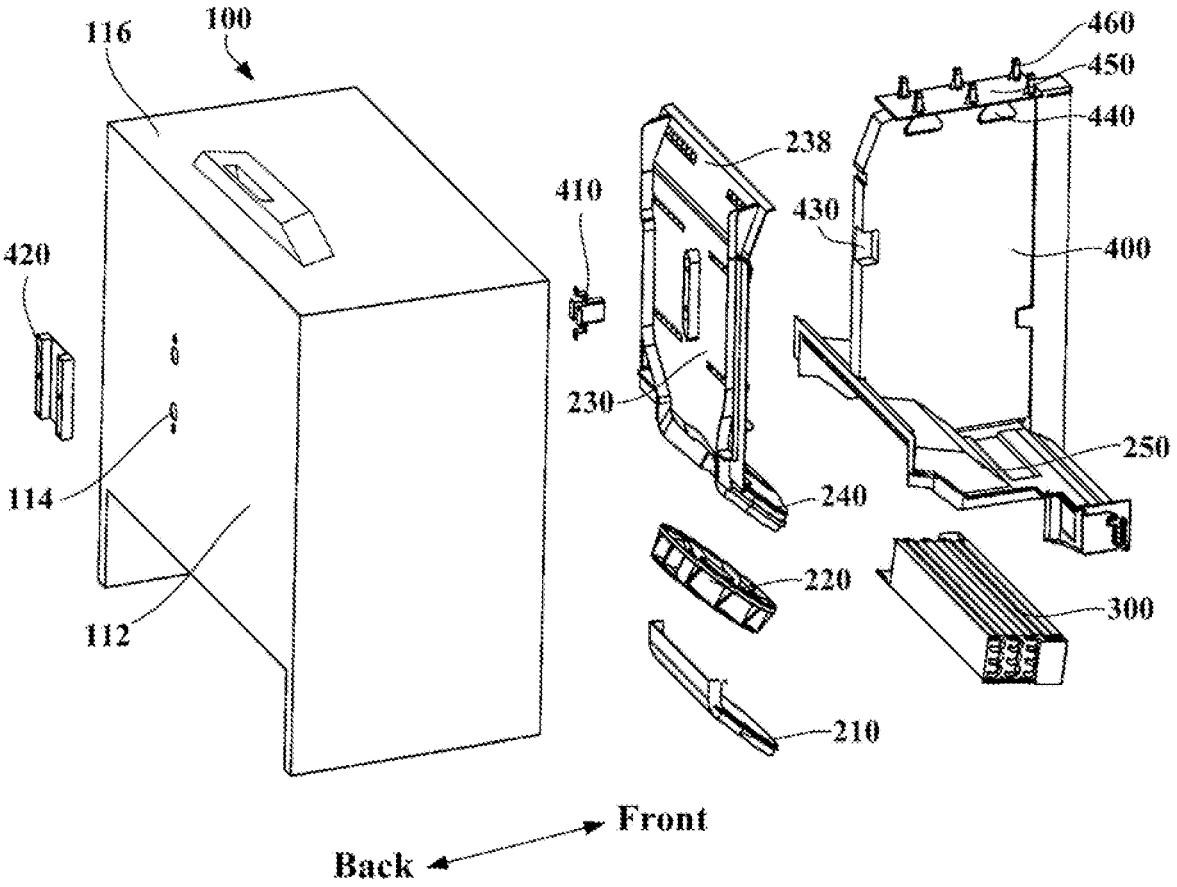
FIG. 2 is an exploded view of a refrigerator according to an embodiment of the present invention, with a housing being hidden.
Figure 3:
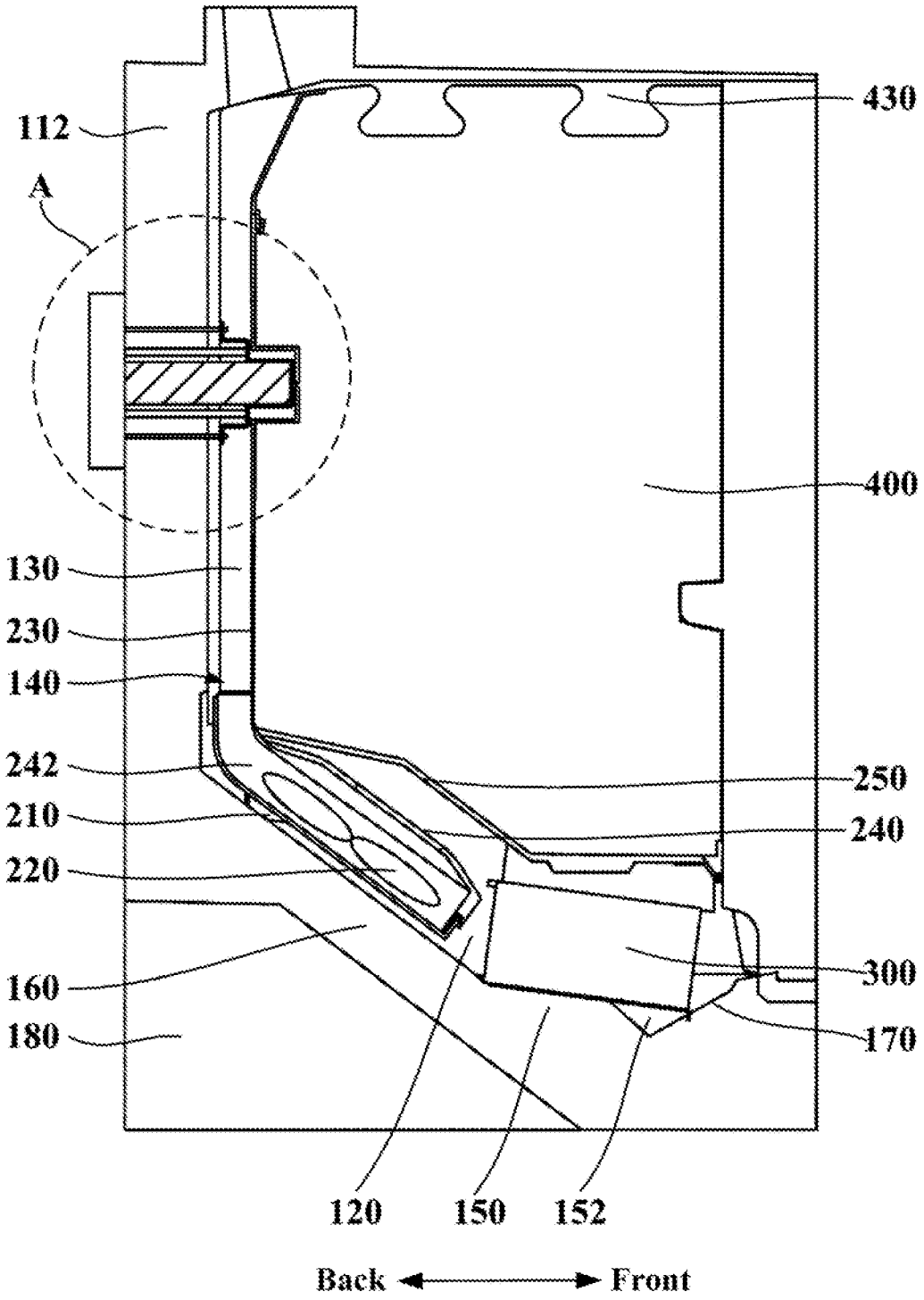
FIG. 3 is a sectional view of a refrigerator according to an embodiment of the present invention, with a housing being hidden.
Figure 4:
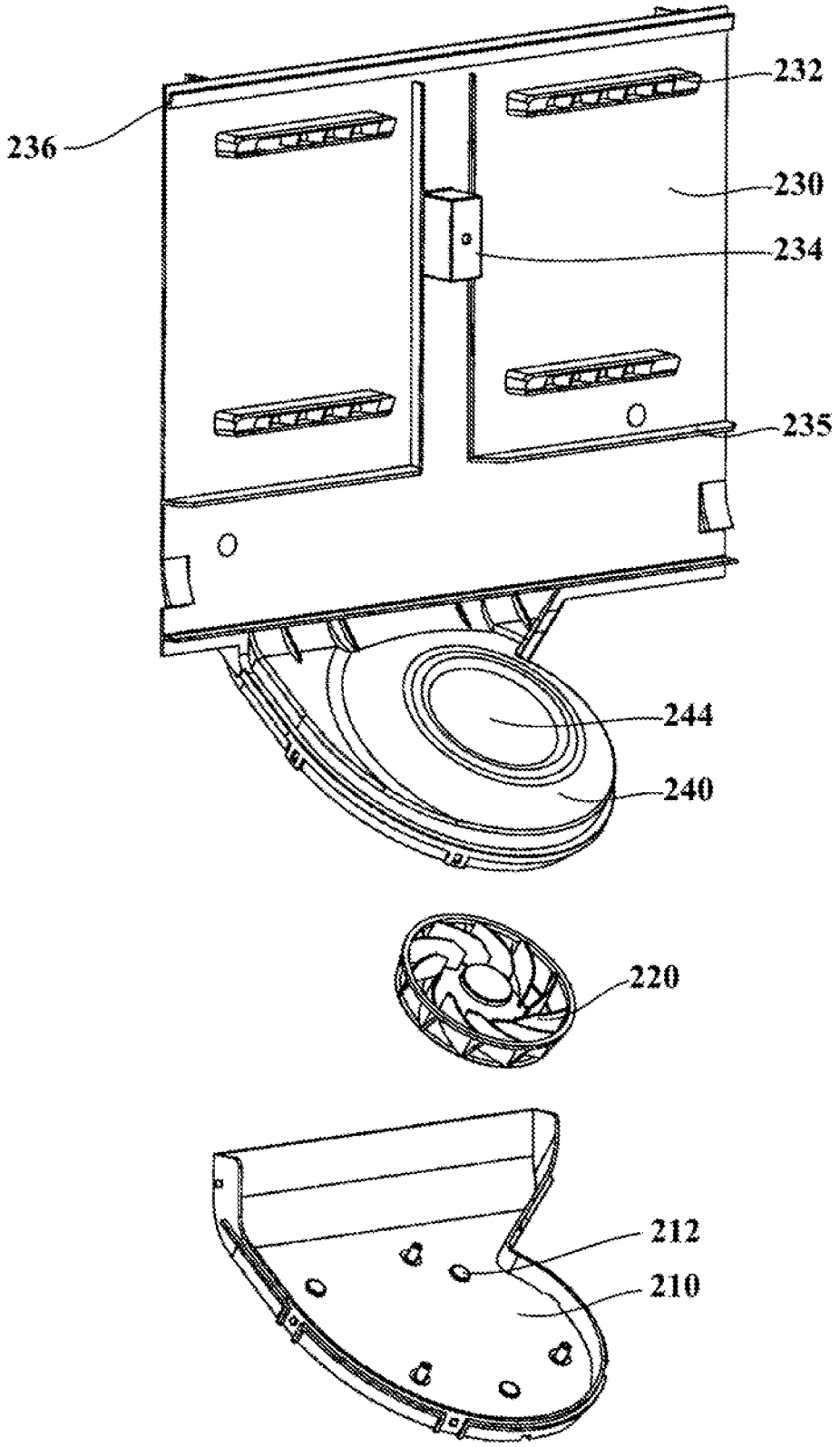
FIG. 4 is a diagram of position relationships between a fan bottom shell, fan blades and an air duct cover plate in a refrigerator according to an embodiment of the present invention, with a bend segment on a back plate portion being hidden.

See FIGS. 2 to 4, the refrigerator 1 may also include a fan bottom shell 210, fan blades 220 and an air duct cover plate. A cooling chamber 120 and a storage space are defined in the bottom liner 100. The cooling chamber 120 is provided below the storage space. The fan bottom shell 210 is provided on a rear portion of the cooling chamber 120.

The air duct cover plate may also include a back plate portion 230 and a fan upper cover 240. The back plate portion 230 is provided in front of a rear wall 112 of the bottom liner 100, and defines an air supply duct 130 together with the rear wall 112 of the bottom liner 100, and at least one air supply outlet 232 is formed in the back plate portion 230 and configured to make the air supply duct 130 communicate with the storage space. The fan upper cover 240 obliquely extends downwards from a lower end of the back plate portion 230 into the cooling chamber 140, covers the fan bottom shell 210 and is fastened thereto to form, together with the fan bottom shell 210, a fan cavity 242 for accommodating the fan blades 220, and the back plate portion 230 and the fan upper cover 240 are integrally formed. The fan blades 220 are provided inside the fan cavity 242, and enable the formation of a refrigeration air flow discharged from the cooling chamber 120 to the air supply duct 130.

In the embodiment, an evaporator upper cover 250 is provided at a lower portion of the bottom liner 100. The evaporator upper cover 250 is transversely provided inside the bottom liner 120 and configured to define the liner 100 as the cooling chamber 120 and the storage space. The cooling chamber 120 is provided below the storage space, and an evaporator 300 is provided inside the cooling chamber 120.

That is, the evaporator 300 in the embodiment is provided at the lower portion of the bottom liner 100, and such a manner may avoid the reduction of depth of a freezing compartment due to the occupation of a rear space of the freezing compartment by an evaporator in a traditional refrigerator. Especially for a side-by-side refrigerator, it is especially important to increase the depth dimension of the freezing compartment when its transverse dimension is small. Thus, the space utilization of the refrigerator 1 is improved, and objects that are large and difficult to be divided are stored advantageously.

Additionally, in the traditional refrigerator, the freezing compartment on the lowest portion has a low position, a user needs to bend down significantly or squat down to pick up and place objects in the freezing compartment. Thus, it is inconvenient for the user to use, especially for the elderly. However, in the embodiment, since the lower space of the bottom liner 100 is occupied by the cooling chamber 120, the height of the storage space above the cooling chamber 120 is raised, and the degree of bending down is reduced when the user picks up and places the objects in the storage space, thereby improving the user experience of the user.

In the embodiment, the evaporator 300 has an overall flat cuboid shape, is arranged at the front portion of the cooling chamber 120, and is obliquely provided in the cooling chamber 120. This mode breaks through the technical shackle that, in the prior art, an evaporator needs to be placed horizontally to reduce the depth dimension. Although oblique placement of the flat cuboid evaporator 300 may increase the length in a front-back direction, it makes other components inside the cooling chamber 120 arranged more reasonably, and it is verified from actual analysis of an air flow field that air circulation efficiency is higher, and water drainage is smoother. The layout of oblique placement of the evaporator 300 is one of the main technical improvements made in the embodiment. In some specific embodiments, an inclination angle of the evaporator 300 is set within a range from 7 to 8 degrees, e.g., 7 degrees, 7.5 degrees and 8 degrees, preferably 7.5 degrees.

The back plate portion 230 may serve as at least one portion of a duct plate of the bottom liner 100, may be roughly parallel to the rear wall 112 of the bottom liner 100, and is located in front of the rear wall 112 of the bottom liner, so as to define the air supply duct 130 together with the rear wall 112 of the bottom liner. The fan upper cover 240 obliquely extends downwards from the lower end of the back plate portion 230 into the cooling chamber 120. Since the evaporator upper cover 250 serves as a separation part between the cooling chamber 120 and the storage space. that is, the evaporator upper cover 250 is located above the fan upper cover 240, the upper end of the evaporator upper cover 250 may be connected with the back plate portion 230, so as to play a role in sealing a gap between the cooling chamber 120 and the air supply duct 130.

In the embodiment, the back plate portion 230 and the fan upper cover 240 are integrally formed. Such manner is different from a duct plate and a fan volute in the prior art. As mentioned in the background art, in an existing refrigerator, the duct plate and the fan volute provided in the duct plate are generally two devices independent of each other. During assembly, an installer generally needs to connect the duct plate with the fan volute by means of a large number of fasteners, which may lead to a complex installation process and increased cost, thus being not conducive to mass production.

However, in the embodiment, the back plate portion 230 and the fan upper cover 240 are integrally formed to form modularization, thereby facilitating mass production. And during assembly, the installer may install an integrally-formed piece first, and then may directly connect the evaporator upper cover 250 with the integrally-formed piece, thereby simplifying installation processes and reducing costs, and ensuring the stability of a whole air duct structure.

In the embodiment, the fan bottom shell 210 is provided at the rear portion of the cooling chamber 120 and located below the fan upper cover 240. The middle of the fan bottom shell 210 is sunken downwards, and the outer edges thereof are provided with a plurality of buckles (not shown in the figures). Clamping grooves matched with the buckles of the fan bottom shell are formed at the outer edges of the fan upper cover to fix the fan bottom shell 210 to the fan upper cover 240.

The fan bottom shell 210 and the fan upper cover 240 form the fan cavity 242 for accommodating the fan blades 220. The fan blades 220 are provided inside the fan cavity 242. The evaporator 300 inside the cooling chamber 120 conducts heat exchange with surrounding air, so as to make its temperature reduced. The fan blades 220 prompt the refrigeration air flow to be discharged from the cooling chamber 120 to the air supply duct 130, and then to enter the storage space from the air supply outlet 232 in the back plate portion 230, so as to conduct heat exchange with air in the storage space to reduce the temperature of the storage space. The evaporator upper cover 250 may also have a return air inlet (not shown in the figures) on its front side that makes the storage space communicate with the cooling chamber 120, such that after heat exchange, the refrigeration air flow may flow back to the cooling chamber 120 via the return air inlet to continue the heat exchange with the evaporator 300, so as to form a circulating air flow path.

See FIGS. 2 to 4, in some specific embodiments, the fan blades 220 may also be centrifugal blades. The fan cavity 242 formed by the fan upper cover 240 and the fan bottom shell 210 has a volute shape. An air inlet 244 is formed in the fan upper cover 240. An exhaust outlet 140 is formed at a position where the fan upper cover 240 is connected with the back plate portion 230.

The centrifugal blades may make an air flow from the air inlet 244 discharged in a direction perpendicular to the air inlet 244. In the embodiment, the fan upper cover 240 is provided with the air inlet 244. The air flow from the cooling chamber 120 is sucked by the centrifugal blades and then discharged to the fan cavity 242 in the direction perpendicular to the air inlet 244. The exhaust outlet 140 is formed at the position where the fan upper cover 240 is connected with the back plate portion 230. The exhaust outlet 140 is connected with the fan cavity 242 and the air supply duct 130 to convey the refrigeration air flow pressurized by the fan blades 220 to the air supply duct 130.

See FIG. 3, in some embodiments of the present invention, a bottom wall of the bottom liner 100 includes an evaporator supporting part 150 and a fan supporting part 160. The evaporator supporting part 150 is configured to support the evaporator 300. The fan supporting part 160 is obliquely provided upwards from front to back from a rear end of the evaporator supporting part 150. The fan bottom shell 210 is fixed to the fan supporting part 160, such that the fan cavity 242 is overall obliquely provided behind the evaporator 300.

In the embodiment, the evaporator supporting part 150 is connected with the fan supporting part 160, and may serve as a part of a separation plate in a refrigerator body 10 for separating the liner 100 from a compressor compartment 180. An oblique part 170 may also be provided in front of the evaporator supporting part 150. The oblique part 170 is obliquely provided downwards from front to back from a front end of the bottom wall of the bottom liner 100. The evaporator supporting part 150 is obliquely provided upwards from front to back from a rear end of the oblique part 170, so as to obliquely provide the evaporator 300 in the cooling chamber 120, and a drainage channel 152 is formed at a position where the oblique part 170 is connected with the evaporator supporting part 150, so as to receive defrosting water on the evaporator 300.

The fan supporting part 160 is obliquely provided upwards from front to back from the rear end of the evaporator supporting part 150. In some preferable embodiments, an inclination angle of the fan supporting part 160 is greater than that of the evaporator supporting part 150. The inclination angle of the fan supporting part 160 is set within a range from 36 to 37 degrees relative to the horizontal direction, e.g., 36 degrees, 36.5 degrees and 37 degrees, preferably 36.7 degrees. Correspondingly, the fan bottom shell 210 acts on the fan supporting part 160, and may also be obliquely provided at the angle mentioned above.

Figure 5:
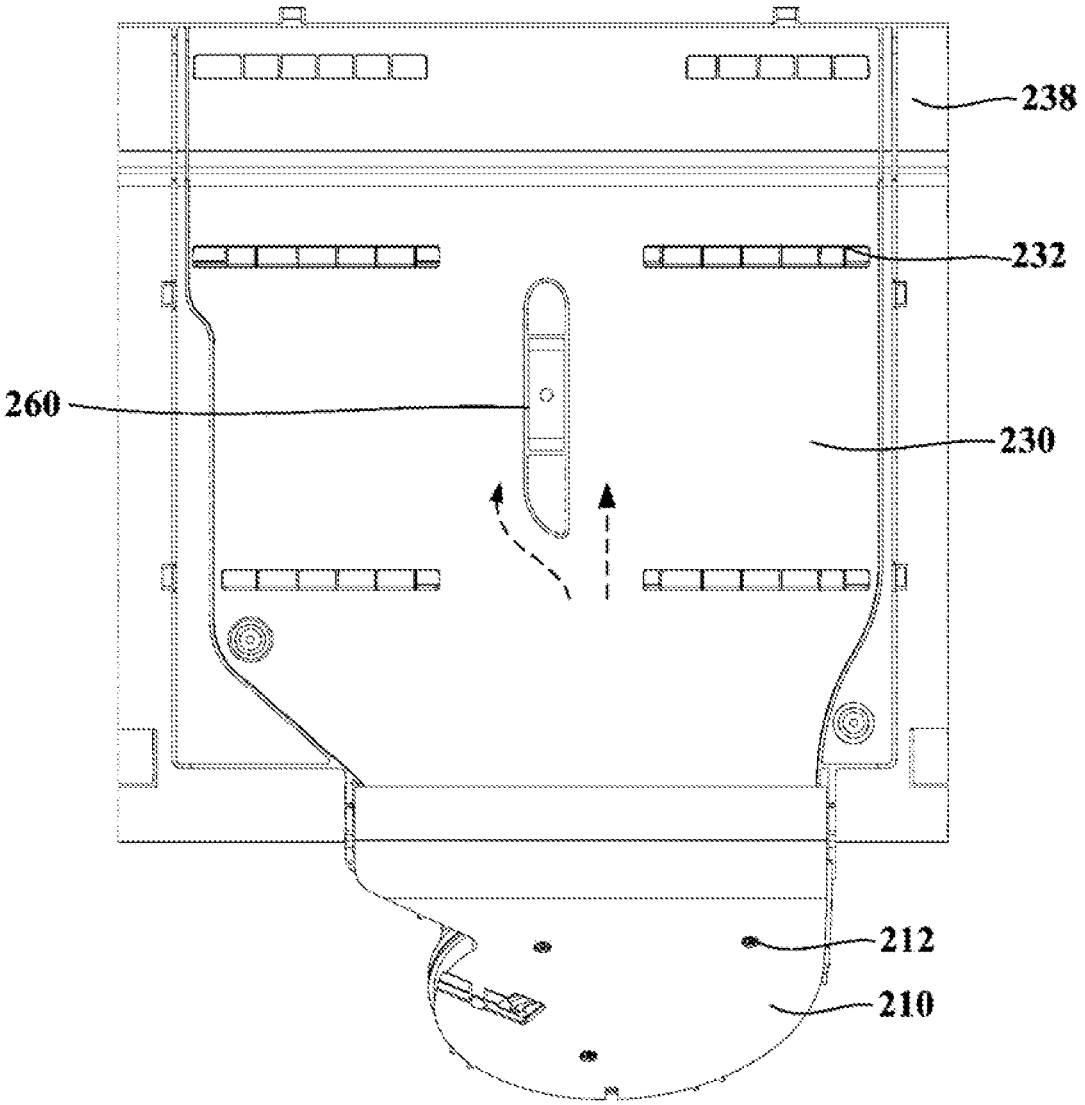
FIG. 5 is a schematic diagram of an air duct cover plate in a refrigerator according to an embodiment of the present invention, with a bend segment on a back plate portion being hidden and a dashed line showing a direction of an air flow flowing through an air guiding jacket.
Figure 6:
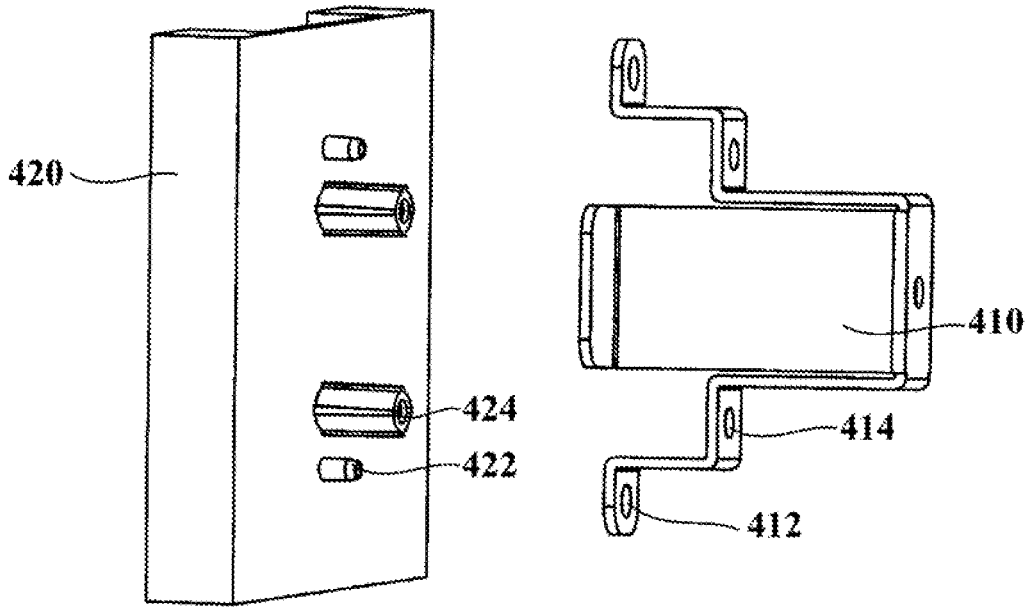
FIG. 6 is a schematic diagram of a back fixing assembly in a refrigerator according to an embodiment of the present invention.
Figure 7:
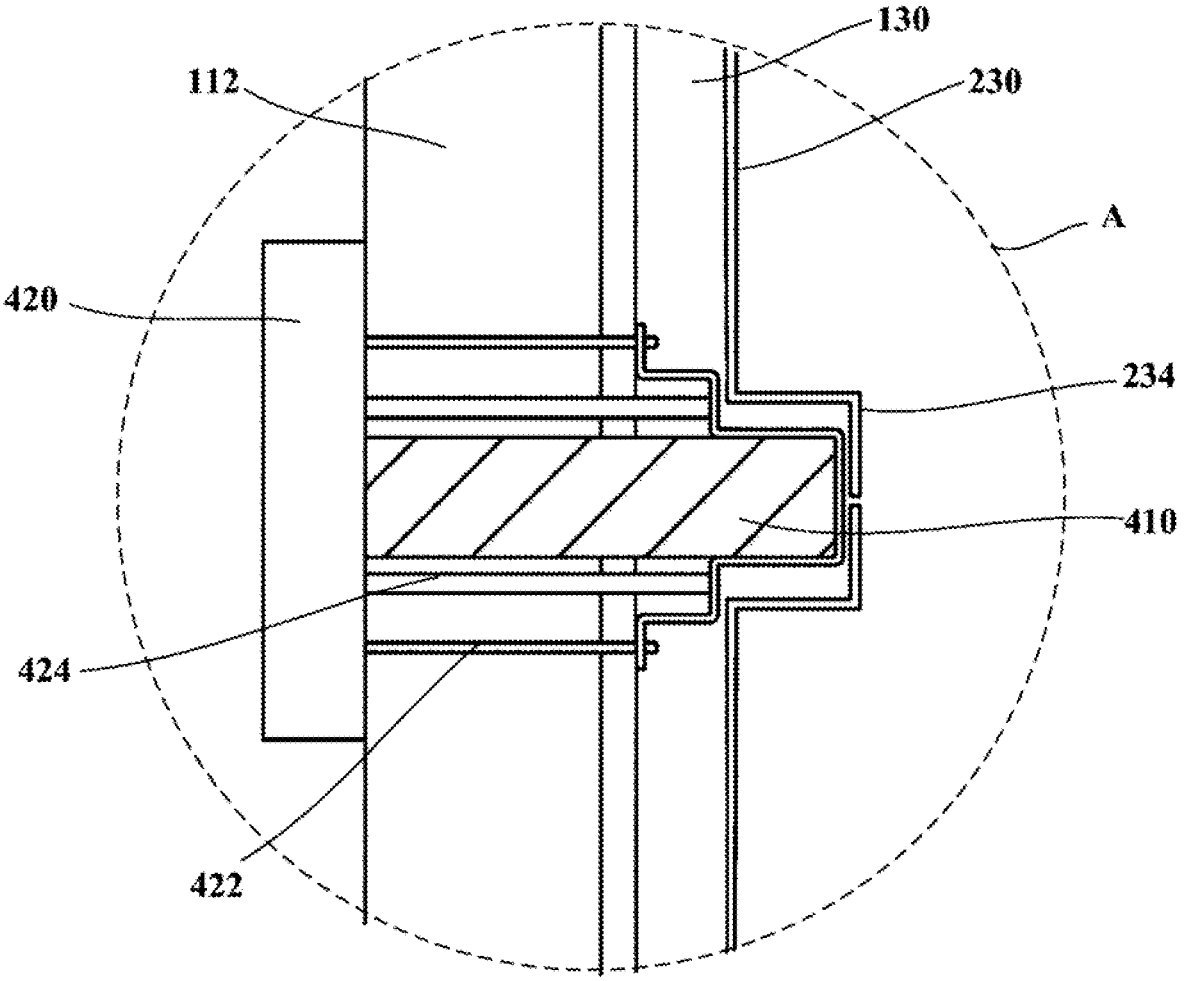
FIG. 7 is an enlarged view of part A in FIG. 3.

See FIGS. 4 and 5, in some embodiments of the present invention, the bottom of the fan bottom shell 210 is provided with a plurality of damping adhesive pads 212, and bonded to the fan supporting part 160 by using the plurality of damping adhesive pads 212. The damping adhesive pads 212 are made of flexible and viscous materials. As shown in FIGS. 4 and 5, the bottom of the fan bottom shell 210 is provided with three damping adhesive pads 212 protruding outwards, which are distributed on the lower portion of the fan bottom shell 210 roughly at 120 degrees, so as to bond the fan supporting part 160 to the fan bottom shell 210. Meanwhile, the damping adhesive pads 212 made of the flexible materials may also effectively reduce noise of the fan blades 220 during operation, and reduce the vibration transfer efficiency of the fan blades during operation, thereby improving the user's sense of experience. It should be illustrated that the number of the damping adhesive pads 212 may also be set as two, four, five and more, and the specific number and distribution positions of the damping adhesive pads 212 are not particularly specified in the present invention.

See FIGS. 2 to 7, in some embodiments of the present invention, the refrigerator 1 may also include a longitudinal partition 400 and a back fixing assembly. The longitudinal partition 400 is vertically provided in the middle of the storage space to separate the storage space into two transversely-arranged storage cavities. The back fixing assembly is arranged on the rear wall 112 of the bottom liner 100, and has a supporting block 410 facing the storage space so as to support the longitudinal partition 400 by using the supporting block 410.

In the embodiment, the longitudinal partition 400 may be provided between the evaporator upper cover 250 and a top wall of the storage space, and a rear portion of the longitudinal partition 400 may abut against the back plate portion 230, so as to separate the storage space into the two transversely-arranged storage cavities while ensuring the two transversely-arranged storage cavities share the same evaporator 300.

As for an existing refrigerator with a partition in a liner, the partition is mainly borne by a supporting structure of a front end vertical beam and a support of a bottom cover plate, there is no bearing structure provided at a back duct, and consequently, there is a certain risk of bearing in the rear portion.

In order to overcome the defects in the prior art, in the refrigerator 1 of the embodiment, the back fixing assembly is provided on the rear wall 112 of the bottom liner 100, and the longitudinal partition 400 is supported by the supporting block 410, such that the longitudinal partition is indirectly connected with the rear wall 112 of the bottom liner 100, so as to distribute part of the weight of the longitudinal partition 400 to the bottom liner 100, thereby reducing the weight borne by the evaporator upper cover 250 and avoiding the evaporator upper cover 250 from deforming due to excessive weight bearing.

Specifically, the back fixing assembly may also include a supporting base 420 and a bearing frame, and the supporting base 420 is fixed to the rear side of the back portion of the bottom liner 100. The bearing frame is provided on the front side of the back portion of the bottom liner 100 and connected with the supporting base 420 by means of a fastener, and the bearing frame protrudes towards the storage space to form the supporting block 410; and the back plate portion 230 forms a supporting jacket 234 protruding towards the storage space at a position corresponding to the bearing frame, the supporting block 410 is inserted into the supporting jacket 234, and the supporting jacket 234 is matched with a fixing structure provided at the rear end of the longitudinal partition 400, such that the longitudinal partition 400 is supported by matching the supporting jacket 234 with the fixing structure of the longitudinal partition 400.

A surface of the supporting base 420 facing the bottom liner 100 has a plurality of protruding positioning pins 422 and a plurality of protruding fixing columns 424, and threads may be formed in the fixing columns 424; and correspondingly, the bearing frame is provided with a plurality of positioning holes 412 connected with the positioning pins 422 in a nesting manner and a plurality of connecting holes 414 connected with the fixing columns 424, and installation holes 114 allowing the positioning pins 422 and the fixing columns 424 to extend thereinto are formed in the rear wall 112 of the bottom liner 100. The positioning pins 422 penetrate through the installation holes 114 and then extend into the positioning holes 412, and the fixing columns 424 are fixed to the connecting holes 414 by means of fasteners, such that the supporting base 420 and the supporting block 410 are fixedly provided on the rear wall 112 of the bottom liner 100.

The fixing structure provided at the rear end of the longitudinal partition is a sunken part 430 matched with the supporting jacket 234, the back plate portion 230 forms the supporting jacket 234 protruding towards the storage space at the position corresponding to the bearing frame, the supporting block 410 may extend into the supporting jacket 234, and then an assembly formed by the supporting block 410 and the supporting jacket 234 extend into the sunken part 430; in this way, the rear wall 112 of the bottom liner 100, the back plate portion 230 and the longitudinal partition 400 are fixed together by means of the back fixing assembly, so as to transfer part of the weight of the longitudinal partition 400 to the rear wall 112 of the bottom liner 100, thereby sharing the pressure of the evaporator upper cover 250.

In the embodiment, the upper portion of the longitudinal partition 400 may also be provided with an upper portion fixing piece. The upper portion fixing piece may also include a hooking part 440, a hanging plate 450 and an elastic clamping jaw 460. The top of the longitudinal partition 400 may also be correspondingly provided with a hooking matching part matched with the hooking part 440. The hanging plate 450 may have a shape of a flat plate, and may abut against the lower portion or the upper portion of a top wall 116 of the bottom liner or may be arranged inside the top wall 116 of the bottom liner. The elastic clamping jaw 460 may extend upwards from an upper surface of the hanging plate 450 so as to be connected with a supporting body of the upper portion fixing piece to further distribute the weight of the longitudinal partition 400 to the bottom liner 100 and the supporting body of the upper portion fixing piece, thereby further sharing the pressure of the evaporator upper cover 250.

See FIG. 5, in some embodiments of the present invention, a side of the back plate portion 230 facing the air supply duct 130 forms the air guiding jacket 260 on the periphery of the bearing frame to avoid the air flow from forming a turbulent flow at the bearing frame.

When the supporting block 410 is inserted into the supporting jacket 234, the air flow flowing through the supporting block 410 tends to form a turbulent flow above the supporting block 410 after being subjected to interference, causing a certain loss of wind speed. The air guiding jacket 260 in the embodiment may guide the air flow flowing through the supporting block 410, thereby making the air flow smoother.

See FIG. 5, the dashed line in FIG. 5 shows the air flow flowing through the air guiding jacket 260. Specifically, the air guiding jacket 260 is provided extending along the height direction of the back plate portion 230, and forms a streamline tip at its bottom end to guide the air flow by using the tip. The streamline tip may have a shape that gradually expands upwards from a lower portion thereof, and at least one edge is provided into a smooth arc shape to make the air flow pass through the supporting block 410 smoothly, thereby reducing resistance to the air flow.

Figure 8:
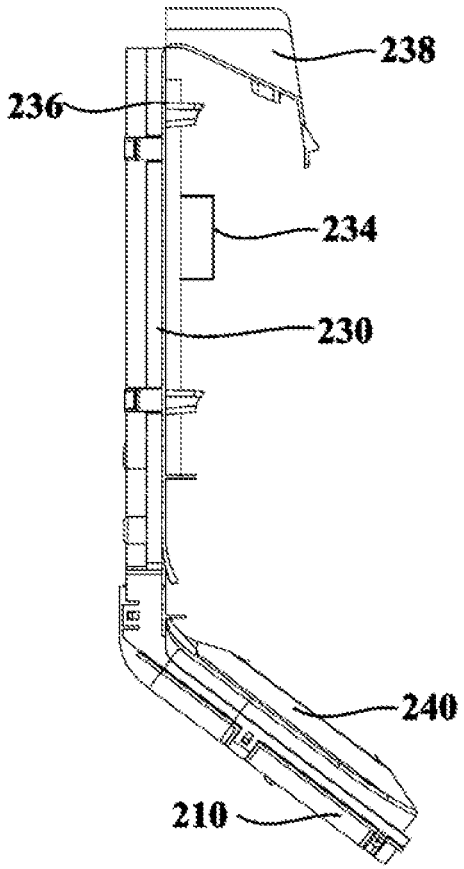
FIG. 8 is a schematic diagram of another view of an air duct cover plate in a refrigerator according to an embodiment of the present invention, showing a state of folding down by 90 degrees of a bend segment on a back plate portion.

See FIGS. 4 and 8, in some embodiments of the present invention, the air duct cover plate is an integrally injection-molded single-layer plate, and the upper portion of the back plate portion 230 is provided with a crease groove 236 to facilitate bending of the back plate portion 230 by using the crease groove 236 when installing the air duct cover plate.

In the embodiment, the upper portion of the back plate portion 230 is provided with a bend segment 238, and the lower portion of the bend segment 238 may extend into the crease groove 236 and may rotate around the crease groove 236 by a certain angle to reduce the height of the back plate portion 230. During installation, the installer may make the bend segment 28 extend into the crease groove 236 and rotate outwards by a certain angle (as shown in FIG. 8, making the bend segment 238 rotate outwards by 90 degrees) to reduce the height of the back plate portion 230. Then, the installer may connect the rest of the air duct cover plate with the liner 100 or other parts firstly, and finally fold the bend segment 238 to an original position to simplify the installation processes.

See FIG. 4, in some embodiments of the present invention, the back plate portion 230 is also provided with at least one transversely extending water retaining rib 235 below the air supply outlet 232 to block condensate water at the air supply outlet 232 from flowing downwards into the fan cavity 242.

In the embodiment, the water retaining rib 235 may be provided on one side of the back plate portion 230 facing a storage compartment. Since there is part of the condensate water contained in the air flow, when the air flow encounters the back plate portion 230, the condensate water may adhere to its surface, and the water retaining rib 235 may delay the descending of the condensate water and make all condensate water evaporate as far as possible to avoid a failure caused by the falling of the condensate water into the fan cavity 242.

In the embodiment, transverse extension may refer to horizontal extension, or it may also be understood that the water retaining rib 235 has a certain inclination angle. Both of the above modes may delay the falling of the condensate water on the water retaining rib 235.

At this point, it should be recognized by those skilled in the art that, although multiple exemplary embodiments of the present invention have been exhaustively shown and described herein, many other variations or modifications in accordance with the principles of the present invention may still be directly determined or derived from the disclosure of the present invention without departing from the spirit and scope of the present invention. Therefore, the scope of the present invention should be understood and recognized as covering all these other variations or modifications.

What is claimed is:

1. An air-cooled refrigerator, comprising:

a bottom liner, defining a cooling chamber and a storage space, the cooling chamber being provided below the storage space;

a fan bottom shell, provided at a rear portion of the cooling chamber; and an air duct cover plate, comprising:

a back plate portion, provided in front of a rear wall of the bottom liner, and defining an air supply duct together with the rear wall of the bottom liner, at least one air supply outlet being formed in the back plate portion, and the air supply outlet being configured to make the air supply duct communicate with the storage space; and a fan upper cover, obliquely extending downwards from a lower end of the back plate portion into the cooling chamber, covering the fan bottom shell and being fastened thereto to form, together with the fan bottom shell, a fan cavity for accommodating fan blades, the back plate portion and the fan upper cover being integrally formed;

the air-cooled refrigerator further comprising:

the fan blades, provided inside the fan cavity, and enabling formation of a refrigeration air flow discharged from the cooling chamber to the air supply duct;

a longitudinal partition, vertically provided in a middle of the storage space to separate the storage space into two transversely-arranged storage cavities; and a back fixing assembly, provided on the rear wall of the bottom liner, and having a supporting block protruding from the rear wall of the bottom liner towards the storage space to support the longitudinal partition by using the supporting block;

wherein the back fixing assembly comprises:

a supporting base, fixed to a rear side of a back portion of the bottom liner; and a bearing frame, provided on a front side of the back portion of the bottom liner, and connected with the supporting base by means of a fastener, the bearing frame protruding towards the storage space to form the supporting block; and wherein the back plate portion forms a supporting jacket protruding towards the storage space at a position corresponding to the bearing frame, the supporting block is inserted into the supporting jacket, and the supporting jacket is matched with a fixing structure provided at a rear end of the longitudinal partition, such that the longitudinal partition is supported by matching the supporting jacket with the fixing structure of the longitudinal partition.

2. The air-cooled refrigerator according to claim 1, wherein the fan blades are centrifugal blades, and the fan cavity formed by the fan upper cover and the fan bottom shell has a volute shape, an air inlet being formed in the fan upper cover, and an exhaust outlet being formed at a position where the fan upper cover is connected with the back plate portion.

3. The air-cooled refrigerator according to claim 2, further comprising:

an evaporator, having an overall flat cuboid shape and being arranged at a front portion of the cooling chamber;

a bottom wall of the bottom liner comprising:

an evaporator supporting part, configured to support the evaporator; and a fan supporting part, obliquely provided upwards from front to back from a rear end of the evaporator supporting part, the fan bottom shell being fixed to the fan supporting part, such that the fan cavity is overall obliquely provided behind the evaporator.

4. The air-cooled refrigerator according to claim 3, wherein a bottom of the fan bottom shell is provided with a plurality of damping adhesive pads, and bonded to the fan supporting part by using the plurality of damping adhesive pads.

5. The air-cooled refrigerator according to claim 1, wherein one side of the back plate portion facing the air supply duct forms an air guiding jacket on a periphery of the bearing frame to avoid an air flow from forming a turbulent flow at the bearing frame.

6. The air-cooled refrigerator according to claim 5, wherein the air guiding jacket is provided extending along a height direction of the back plate portion, and forms a streamline tip at its bottom end to guide the air flow by using the tip.

7. The air-cooled refrigerator according to claim 1, wherein the air duct cover plate is an integrally injection-molded single-layer plate, and an upper portion of the back plate portion is provided with a crease groove to facilitate bending of the back plate portion by using the crease groove when installing the air duct cover plate.

8. The air-cooled refrigerator according to claim 1, wherein the back plate portion is also provided with at least one transversely extending water retaining rib below the air supply outlet to block condensate water at the air supply outlet from flowing downwards into the fan cavity.

* * * * *